US009475631B2

(12) United States Patent
Kassouni

(10) Patent No.: US 9,475,631 B2
(45) Date of Patent: Oct. 25, 2016

(54) DECORATIVE CONTAINER AND METHOD FOR STORING ICE MELTING MATERIALS

(71) Applicant: Van M. Kassouni, Grand Rapids, MI (US)

(72) Inventor: Van M. Kassouni, Grand Rapids, MI (US)

( * ) Notice: Subject to any disclaimer, the term of this patent is extended or adjusted under 35 U.S.C. 154(b) by 0 days.

(21) Appl. No.: 14/501,765

(22) Filed: Sep. 30, 2014

(65) Prior Publication Data

US 2015/0096914 A1 Apr. 9, 2015

Related U.S. Application Data

(60) Provisional application No. 61/914,181, filed on Dec. 10, 2013, provisional application No. 61/888,172, filed on Oct. 8, 2013.

(51) Int. Cl.
*B65D 81/00* (2006.01)
*B65D 81/36* (2006.01)
*B65D 85/00* (2006.01)

(52) U.S. Cl.
CPC ..... *B65D 81/365* (2013.01); *B65D 85/00* (2013.01)

(58) Field of Classification Search
CPC ..... B65D 85/00; B65D 85/60; A45C 3/00; A45C 3/001; A45C 3/04
USPC ..... 428/34.1, 34.4; 206/457; D7/601, 612, D7/613; D11/121, 125, 128; 220/288, 220/915.1; 383/6, 7, 25
See application file for complete search history.

(56) References Cited

U.S. PATENT DOCUMENTS

| | | | | |
|---|---|---|---|---|
| D245,567 | S * | 8/1977 | Burns | D34/4 |
| 4,467,915 | A * | 8/1984 | Snyder et al. | 206/219 |
| 4,483,455 | A * | 11/1984 | Prophet et al. | 220/23.83 |
| 4,836,396 | A * | 6/1989 | Ancona et al. | 220/212 |
| D351,340 | S | 10/1994 | Drummond et al. | |
| D384,595 | S * | 10/1997 | Hartwell-Ruland | D11/121 |
| 6,318,577 | B1 * | 11/2001 | Suttoni et al. | 220/288 |
| D456,219 | S * | 4/2002 | Kracke | D11/128 |

(Continued)

OTHER PUBLICATIONS

Webpage of Suncast SSW1000 Winter Storage Box for Ice Melt/Sand/Salt Snow De-Icers Reviews found at http://www.gifttool.net/p/suncast-ssw1000-winter-storage-box-for-ice-meltsandsalt-snow . . . , published at least as early as Dec. 27, 2012.

(Continued)

*Primary Examiner* — Steven A. Reynolds
*Assistant Examiner* — Javier A Pagan
(74) *Attorney, Agent, or Firm* — Gardner, Linn, Burkhart & Flory, LLP

(57) ABSTRACT

A decorative container assembly and method are provided for storing traction-enhancing materials such as salt pellets or tablets, sand or gravel. The decorative container includes a container cover and a container base configured for mating together, where at least the container cover has a decorative outer shape and/or surface ornamentation, such as in a winter theme. The base defines an inner storage cavity for holding the traction-enhancing materials, and has a lower mating element for cooperatively engaging an upper mating element of the cover. The upper mating element is removably attachable to the lower mating element in a manner that substantially seals the inner storage cavity. Optionally, the base has a decorative outer shape or ornamentation that cooperates with the cover so that the assembled container forms a complete winter theme. Optionally, the container base may be substantially non-decorative, such as part of the original packaging of the traction-enhancing material.

13 Claims, 12 Drawing Sheets

(56) References Cited

U.S. PATENT DOCUMENTS

| | | | | |
|---|---|---|---|---|
| 2008/0190930 | A1* | 8/2008 | Vogel | B65D 21/0222 220/276 |
| 2009/0064565 | A1* | 3/2009 | Sloop | A01K 97/05 43/57 |
| 2011/0031142 | A1* | 2/2011 | Lindeman | A63B 55/00 206/315.4 |
| 2013/0233877 | A1* | 9/2013 | Thimmesch | B65D 75/566 222/1 |

OTHER PUBLICATIONS

Amazon webpage for Buyers SaltDogg 9031100 8.8 Cubic Foot Poly Snow & Ice Salt/Ice-Melt Box found at heep://www.amazon.com/Buyers-SaltDogg-9031100-Cubic-Ice-Melt/dp/B002WTCF10, published at least as early as Dec. 27, 2012.

* cited by examiner

DECORATIVE CONTAINER AND METHOD FOR STORING ICE MELTING MATERIALS

CROSS REFERENCE TO RELATED APPLICATIONS

The present application claims the filing benefit of U.S. provisional applications, Ser. No. 61/914,181, filed Dec. 10, 2013, and Ser. No. 61/888,172, filed Oct. 8, 2013, which are hereby incorporated herein by reference in their entireties.

FIELD OF THE INVENTION

The present invention relates generally to containers and method for storing snow and ice melting materials.

BACKGROUND OF THE INVENTION

During the winter months, a substantial amount of snow and ice may accumulate on sidewalks and building roofs. It is known to use salt pellets or salt tablets, such as those described in U.S. Pat. No. 6,772,543, which is hereby incorporated herein by reference, to assist in melting the snow or ice. However, these ice melting materials often come packaged in unsightly buckets, tubs, or bags that tend to fall apart with repeated use. While some buckets and tubs are designed with more durable construction, they do little to address the aesthetic concerns. Given that these ice melting materials are typically used to clear snow and ice near the entrances of homes and businesses, users must choose between leaving an unsightly container in plain view of visitors or continually carrying the containers, and the mess they accumulate, indoors. In certain situations, heavier packages of ice melting material may be difficult for some users to move.

SUMMARY OF THE INVENTION

The present invention provides a durable container for storing ice melting materials, with the container having a decorative shape or form or outer surface. According to an aspect of the present invention, the decorative container has both a container base and a container cover. The container base has an opening to an inner storage cavity configured to hold the ice melting material and has a lower mating element at its upper end that defines the opening. The container cover has an upper mating element configured to generally align with the lower mating element or opening of the container base so that when the upper mating element is engaged with the lower mating element, the container cover removably attaches to the container base (such as via threaded attachment or snap attachment or interference fit or the like), thereby substantially sealing and protecting the ice melting material against moisture and spillage. The decorative outer surfaces of the container cover and container base create an aesthetically pleasing storage device that may be kept near the entrances of homes and businesses without detracting from the aesthetics of the entrance area.

Optionally, the decorative outer surface of the container may be based on a winter theme including, but not limited to, a Christmas tree, a snow man, a "Nutcracker" toy soldier or a Santa Claus figure or the like. The container may thus become another element of an owner's outdoor seasonal decorations.

These and other objects, advantages, purposes and features of the present invention will become more apparent upon review of the following specification in conjunction with the drawings.

DESCRIPTION OF THE PREFERRED EMBODIMENTS

Figure 1:
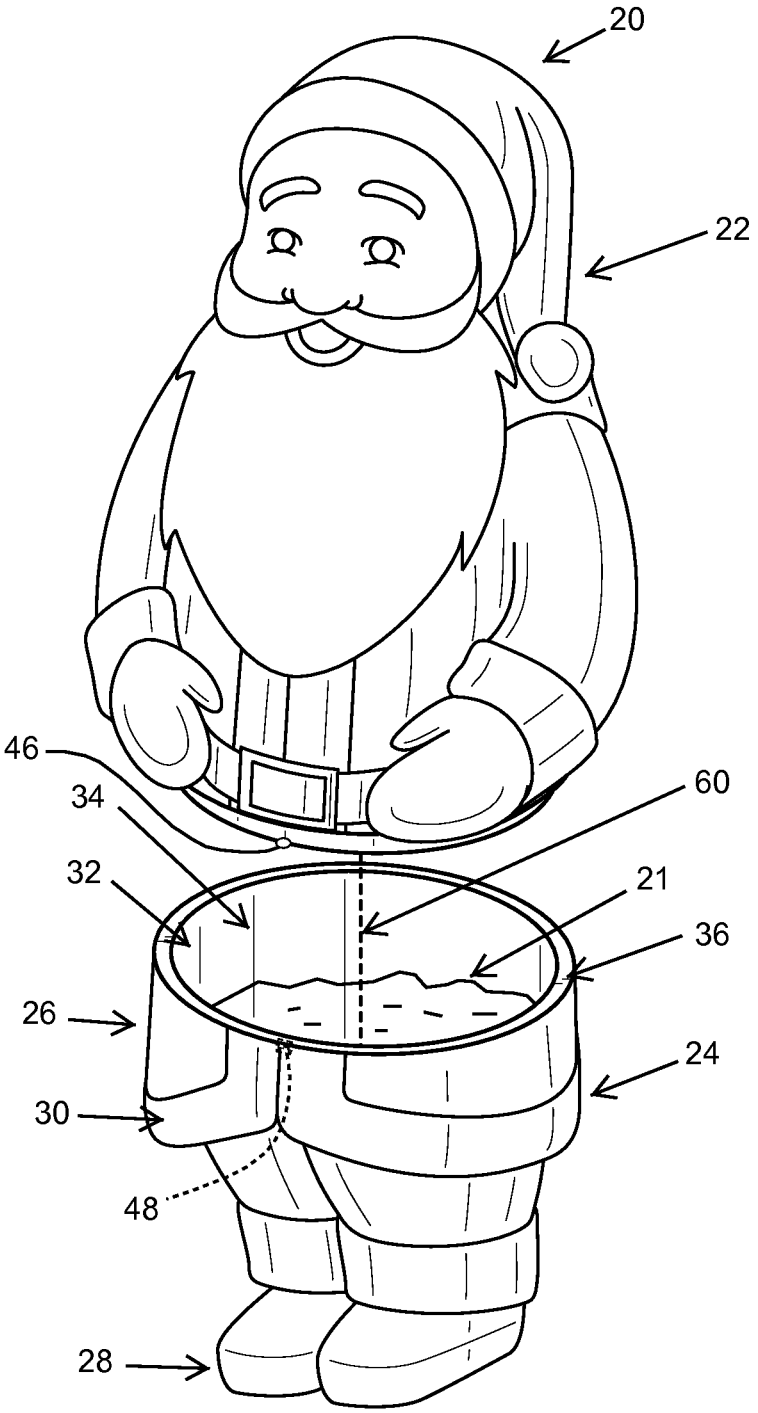
FIG. 1 is a front perspective view of a decorative container for ice melting materials in accordance with the present invention, shown in an open condition with the container cover above the container base.
Figure 2:
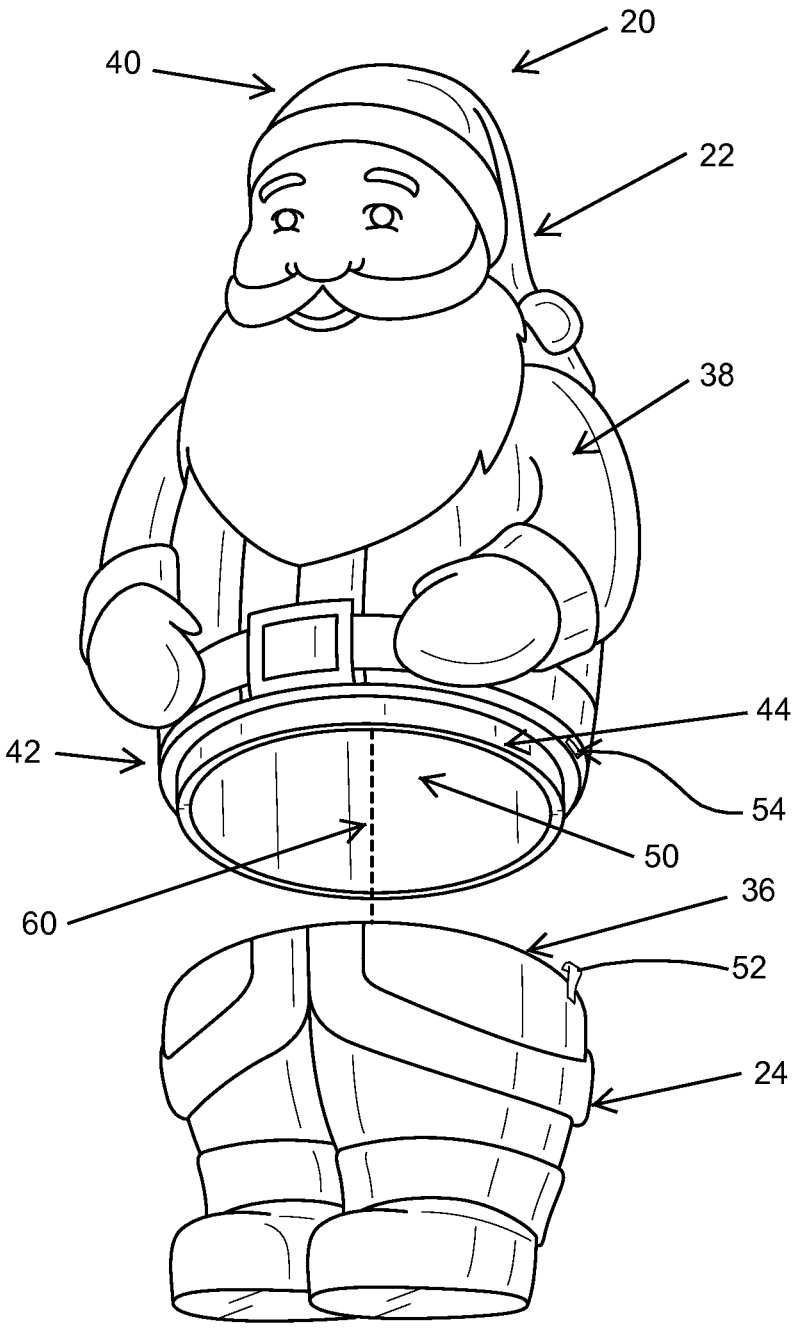
FIG. 2 is a lower perspective view of the decorative container of FIG. 1.
Figure 3:
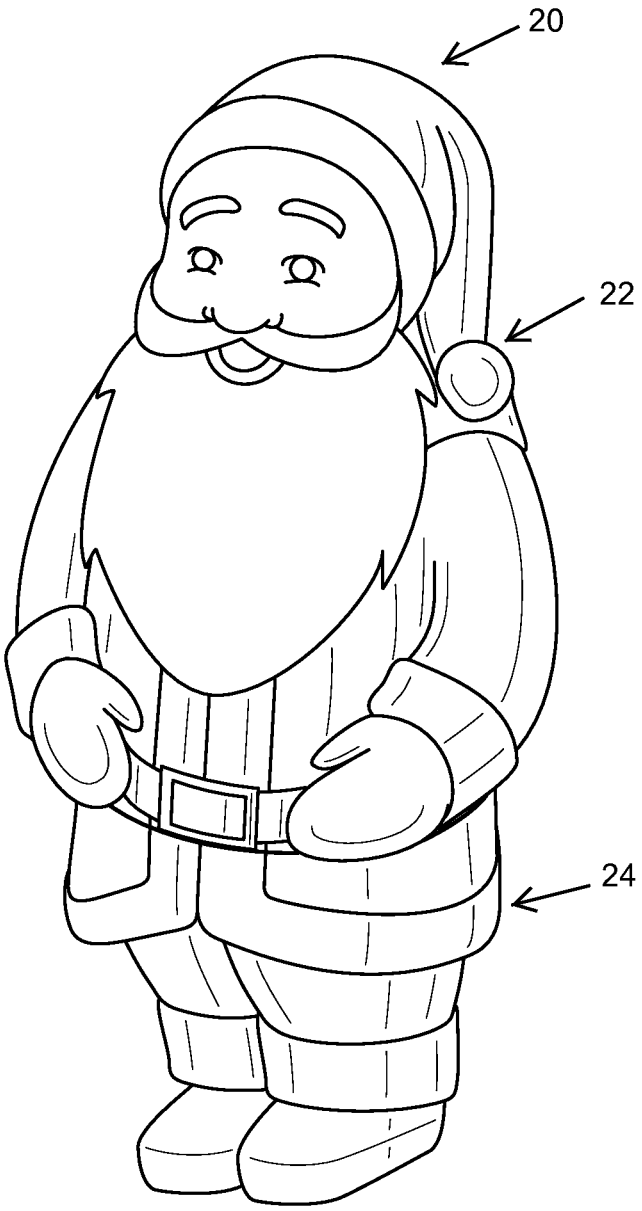
FIG. 3 is another front perspective view of the decorative container of FIGS. 1 and 2, shown in a closed condition with the container cover removably attached to the container base.

Referring now to the drawings and the illustrative embodiments depicted therein, a decorative container 20 used for storing ice melting material 21 includes a container cover 22 and a container base 24, such as shown in FIGS. 1-3. In the illustrated embodiment of FIGS. 1-3, the container is in the form of a Santa Claus figure, but could be other winter-themed or holiday-themed forms or shapes, or substantially any other hollow or partially-hollow decorative shape or form, as discussed below. The container base 24 comprises a hollow structure, which may be shaped or formed to represent a lower portion of a decorative form, such as Santa's legs and feet as shown in FIG. 1. The container cover 22 comprises a hollow or solid structure, which may be shaped or formed to represent an upper portion of the decorative form, such as Santa's body and head as shown in FIG. 1. The hollow container base 24 is configured to hold ice melting or traction-enhancing material 21, such as salt pellets or salt tablets or salt briquettes or sand or the like. The container cover 22 is detachably or removably attachable at the container base 24 to conceal and encase and substantially seal (from environmental substances such as rainwater) the ice melting material 21 in the decorative container 20 when the cover is attached at the base, and to allow for a user to remove and use some of the ice melting material 21 when the container cover 22 is removed from the container base 24, as discussed below. Although the containers of the present invention are described primarily in the context of storing an ice melting or traction-enhancing material, it will be appreciated that the containers may be used for substantially any granular material (e.g., plant fertilizer, bird food, charcoal, etc.) that is commonly used around building entrances or the like.

The container base 24 has an upper end portion 26 and a lower end portion 28, and includes an outer shape or form or surface 30, which is decorative. In the illustrated embodiment of FIGS. 1-3, the outer surface 30 is shaped or formed like Santa's lower half (including legs and boots and the like), but it will be appreciated that the outer surface 30 may be generally cylindrical shaped or conical shaped, with the decorative appearance being printed or colored on the outer surface 30. At the upper end portion 26 of the container base 24 is an opening 32 (FIG. 1). The opening 32 is at the upper end region of an inner storage cavity 34, which is used to hold the ice melting and/or traction-enhancing material 21, such as salt pellets or tablets, sand or the like. The container base 24 includes a lower or base mating element 36 that circumscribes the opening 32 and that is configured to attach at or mate with the container cover 22 when the container cover 22 is used to close or seal the decorative container 20.

The container cover 22 has an upper end portion 40 and a lower end portion 42 with an outer shape or form or surface 38 that is decorative. At the lower end portion 42 of the container cover 22 is an upper or cover mating element 44. In the illustrated embodiment, the upper mating element 44 is recessed in from the outer surface 38 of the container cover 22, so that the upper mating element may be at least partially received in the lower mating element 36 of base 24. The upper mating element 44 is configured to attach at or mate with the lower mating element 36 of the container base 24 when the container cover 22 is used to close or seal the decorative container 20. Optionally, at least the upper mating element 44 of the container cover 22 (and optionally at least a portion of the container cover 22 itself) may have a hollow cavity 50 to allow for receiving ice melting material 21 protruding above the lower mating element 36 of the container base 24.

The opening 32 of the container base 24 and the upper mating element 44 of the container cover 22 are dimensioned such that when the upper mating element 44 of the container cover 22 is aligned with the opening 32 of the container base 24 generally along a central axis 60, the container cover 22 may be removably attached to the container base 24. FIG. 3 shows the decorative container 20 fully assembled with the container cover 22 removably attached to the container base 24.

In the embodiment illustrated in FIGS. 1-3, the upper mating element 44 of the container cover 22 and the opening 32 of the container base 24 are generally circular in shape. However, it is envisioned that these may be any geometrical shape while remaining within the spirit and scope of the present invention. Optionally, it is envisioned that the upper mating element 44 of the container cover 22 and the lower mating element 36 of the container base 24 may be threaded so that the container cover 22 may screw onto or threadedly attach at the container base 24. In such an embodiment, the threads may be configured so that, when the container cover 22 is threaded onto the container base 24, the container cover 22 is fully threaded or tightened onto the container base 24 with Santa's face (of the container cover 22) facing in the same direction as Santa's feet (of the container base 24).

As another option, the upper mating element 44 may have a first retaining element 46, such as at least one protrusion, configured to detachably engage with a corresponding second retaining element 48, such as a recess or tab, of the lower mating element 36 at the opening 32 (FIG. 1), so that the container cover 22 may snap onto or snap attach at the container base 24. Optionally, one or more fasteners, such as threaded screws, hook-and-loop fasteners, latches, resilient latch tabs, magnets, or the like (such as latch tabs 52 and receiving slots 54 shown in FIG. 2), may be used to removably attach the container cover 22 to the container base 24. One skilled in the art will recognize and appreciate the various ways that the container cover 22 may be removably attached to the container base 24. When the container cover 22 is attached at the container base 24, the container cover 22 may substantially seal relative to the container base 24 to limit water and moisture intrusion into the inner storage cavity 34.

Figure 4:
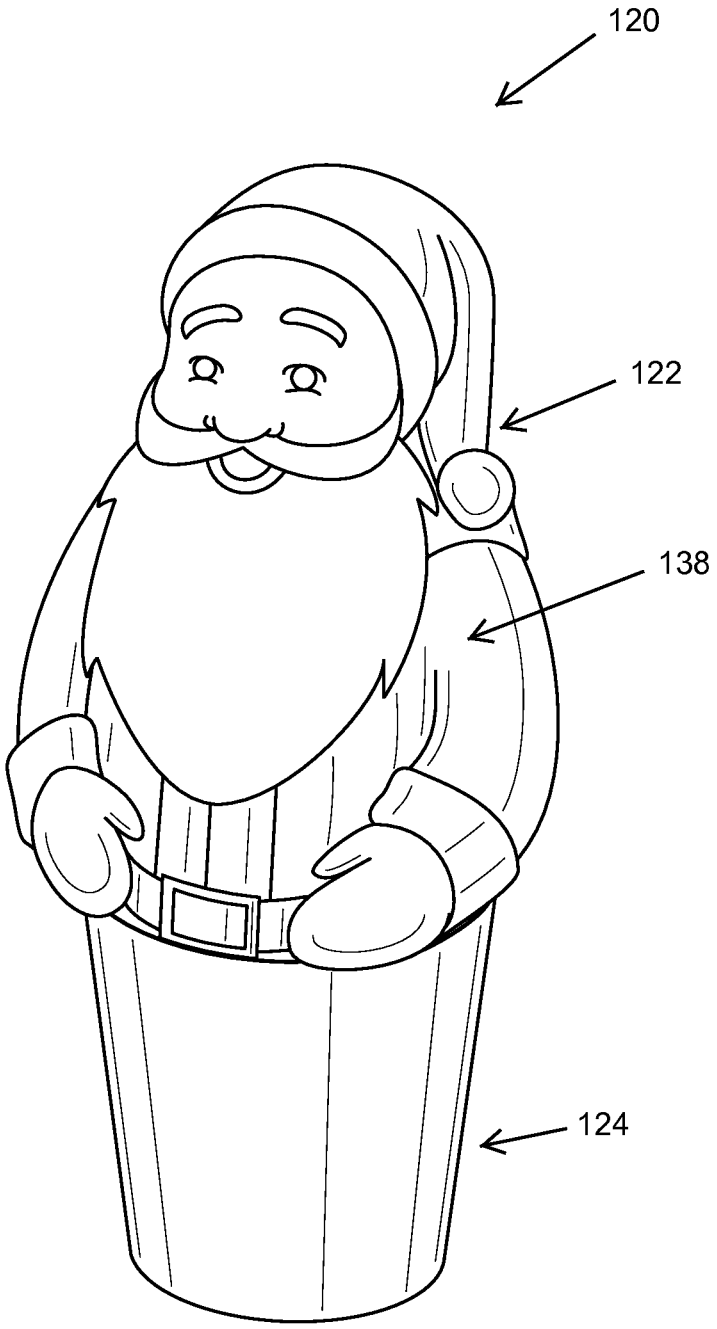
FIG. 4 is a front perspective view of another decorative container for ice melting materials in accordance with the present invention, where the container base is the original packaging container for the ice melting materials.
Figure 5:
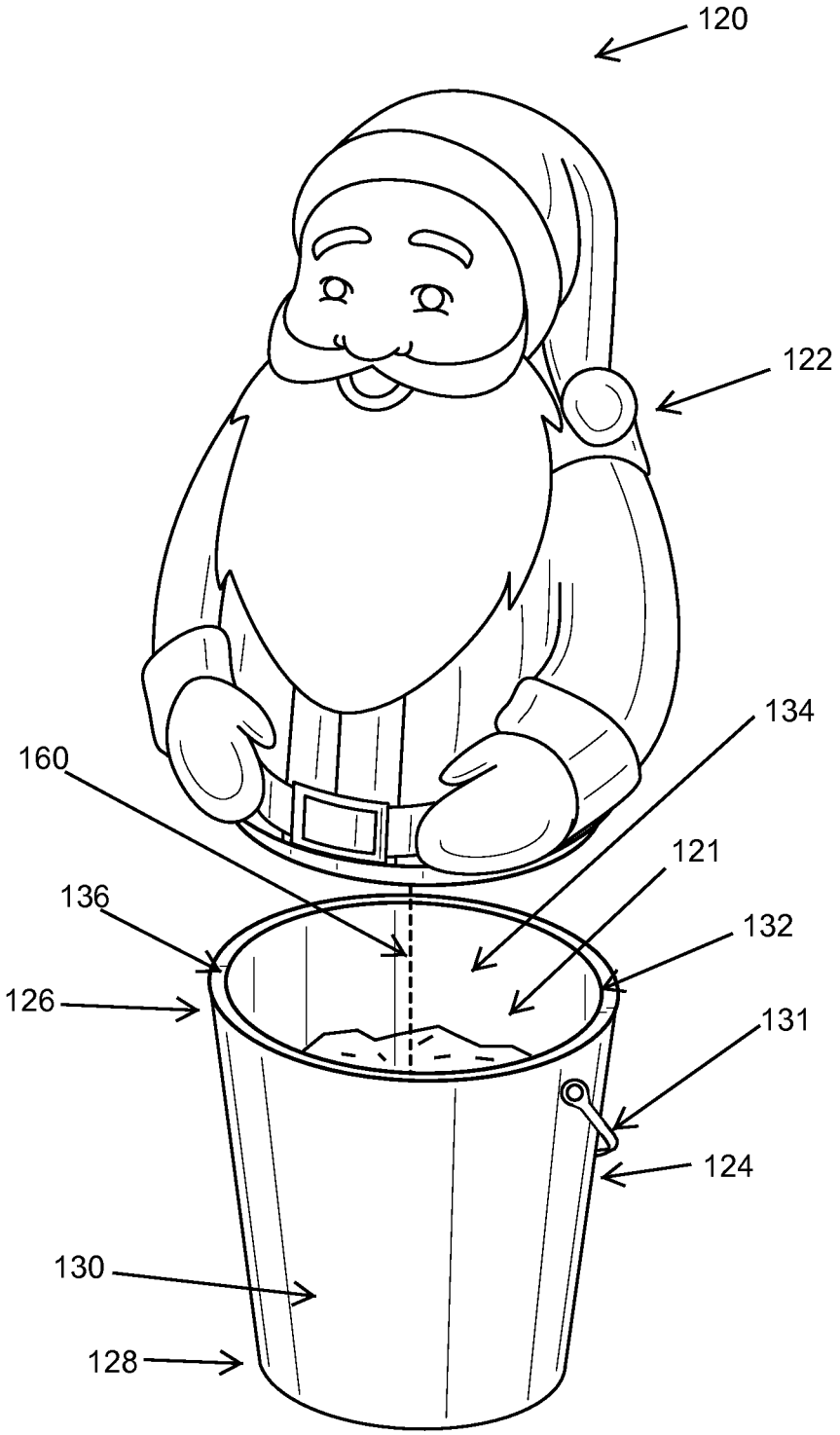
FIG. 5 is another front perspective view of the decorative container of FIG. 4, shown in an open condition with the container cover above the container base.
Figure 6:
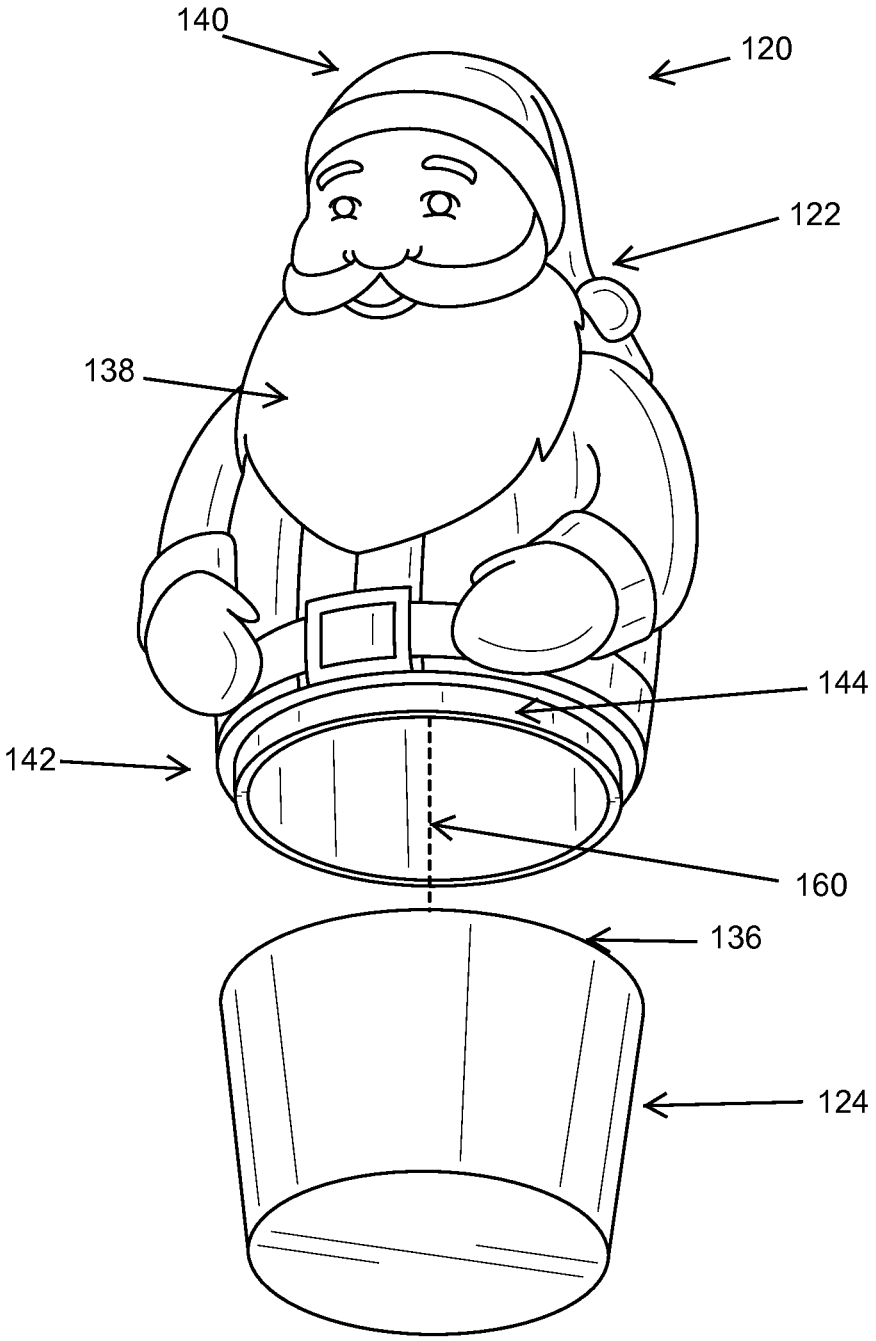
FIG. 6 is a bottom perspective view of the decorative container of FIGS. 4 and 5.

Optionally, and with reference to FIGS. 4-6, a decorative container 120 may provide a decorative container cover 122 (such as similar to container cover 22 described above), which is removably attachable at a container base 124 that is more conventionally shaped as a bucket or tub or the like. Optionally, the container base 124 may be a part of the original packaging (such as a bucket or tub the like, such as a standard 5-gallon bucket or the like) for the ice melting or traction assisting material. Container cover 122 has a decorative outer surface 138 and is removably attached to the container base 124 that is the bucket or tub used to package the ice melting material, such as in a similar manner as cover 22, discussed above. Container cover 122 may be similar to container cover 22, discussed above, such that a detailed discussion of the container covers need not be repeated herein. As shown in FIG. 5, the container base 124 has an upper end 126 and a lower end 128 with an outer surface 130. The outer surface or shape or form of the base comprises a generally cylindrical or conical-shaped or bucket-shaped structure, and may optionally be configured with a carry handle 131 or the like (FIG. 5). Optionally, the outer surface 130 of the container base 124 may be decorated or painted in two or more different colors, or with additional decorative materials (e.g. ribbons, bows, glitter, simulated snow, etc.).

The container base 124 defines an opening 132 at the upper end 126 thereof, and at an upper end region of an inner storage cavity 134, which is used to hold the ice melting material 121. The container base 124 includes a lower mating element 136 that circumscribes the opening 132 and that is configured to attach at or mate with the container cover 122 (such as to the upper mating element of the container cover such as discussed above) when the container cover 122 is used to close or seal the decorative container 120. The container cover 122 has an upper end portion 140 and a lower end portion 142 with an outer shape or form or surface 138 that is decorative.

For example, the upper mating element 144 may be configured to attach at or mate with the lower mating element 136 of the container base 124 when the container cover 122 is used to close or seal the decorative container 120. The opening 132 of the container base 124 and the upper mating element 144 of the container cover 122 are dimensioned such that when the upper mating element 144 of the container cover 122 is aligned with the opening 132 of the container base 124 generally along a central axis 160, the container cover 122 may be removably attached to the container base 124, such as in a similar manner as discussed above (such as via threaded attachment, snap attachment, fastener attachment and/or the like). The lower container may comprise a standard or conventional bucket or tub, which may include an attachment feature (such as one or more ribs or threads) configured to have a flat lid snapped or threaded thereon, and the upper container cover may be configured to mate with the attachment feature or features of the bucket or container. It is envisioned that, prior to purchase by a consumer, container base 124 would be filled with salt or other ice-melting and/or traction-enhancing material, and closed with an original-packaging lid at its lower mating element 136. The consumer would subsequently remove the original-packaging lid and place container cover 122 atop container base 124, such as in the manner described above.

In the illustrated embodiments of FIGS. 1-6, at least the covers of the decorative containers are in the shape of a Santa Claus. Optionally, it is envisioned that the decorative container may be shaped to depict any other winter or seasonal themes or the like, such as, for example, a snowman design or shape (FIGS. 7 and 8), a Christmas tree design or shape (FIGS. 9 and 10), a toy soldier design or shape (FIGS. 11 and 12), or any other suitable or selected design or shape, while remaining within the spirit and scope of the present invention. The decorative container of the present invention is preferably formed or molded from resinous plastic, but may be constructed from any materials suitable for providing the necessary structural integrity and protection from the elements, while also preferably being resistant to corrosion and/or cracking in the presence of salt, moisture, cold winter temperatures and/or the like.

Figure 7:
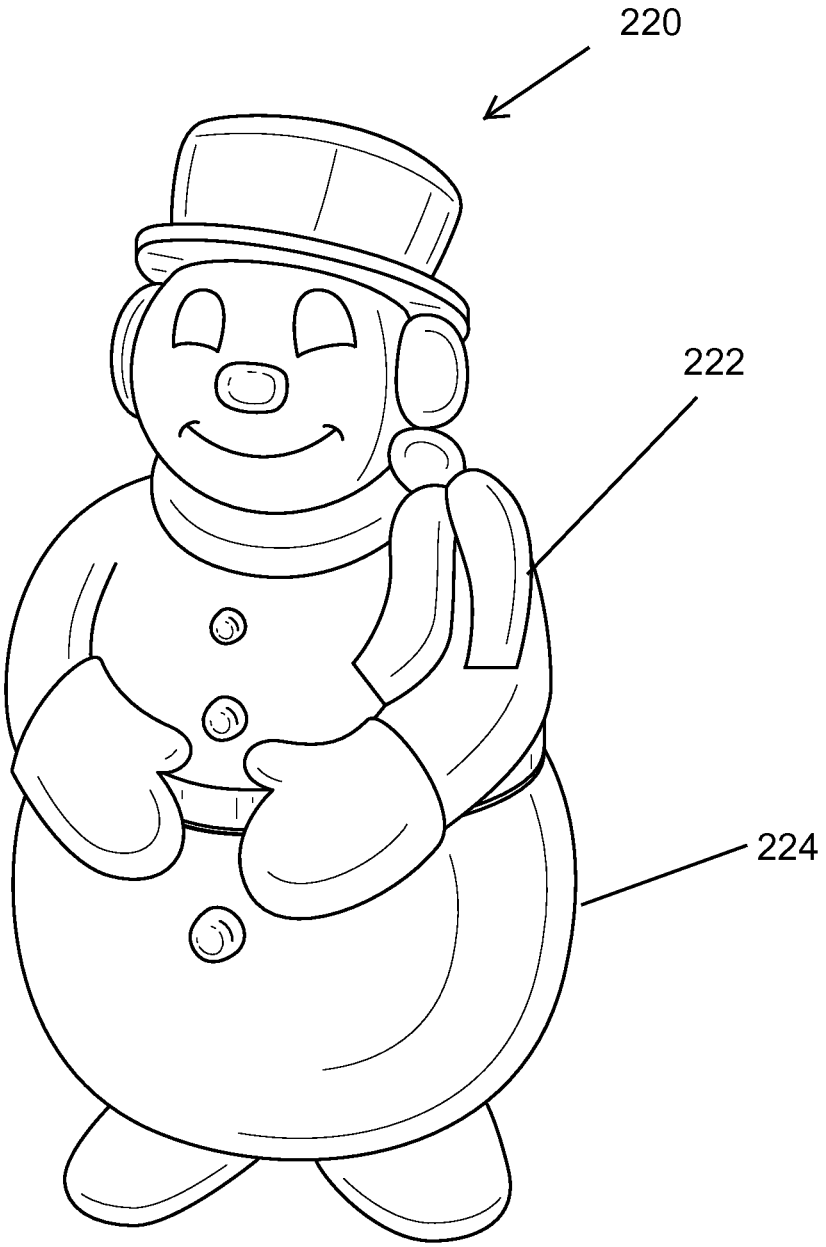
FIG. 7 is a front perspective view of another decorative container for ice melting materials in accordance with the present invention, shown in a closed condition with the container cover removably attached to the container base.
Figure 8:
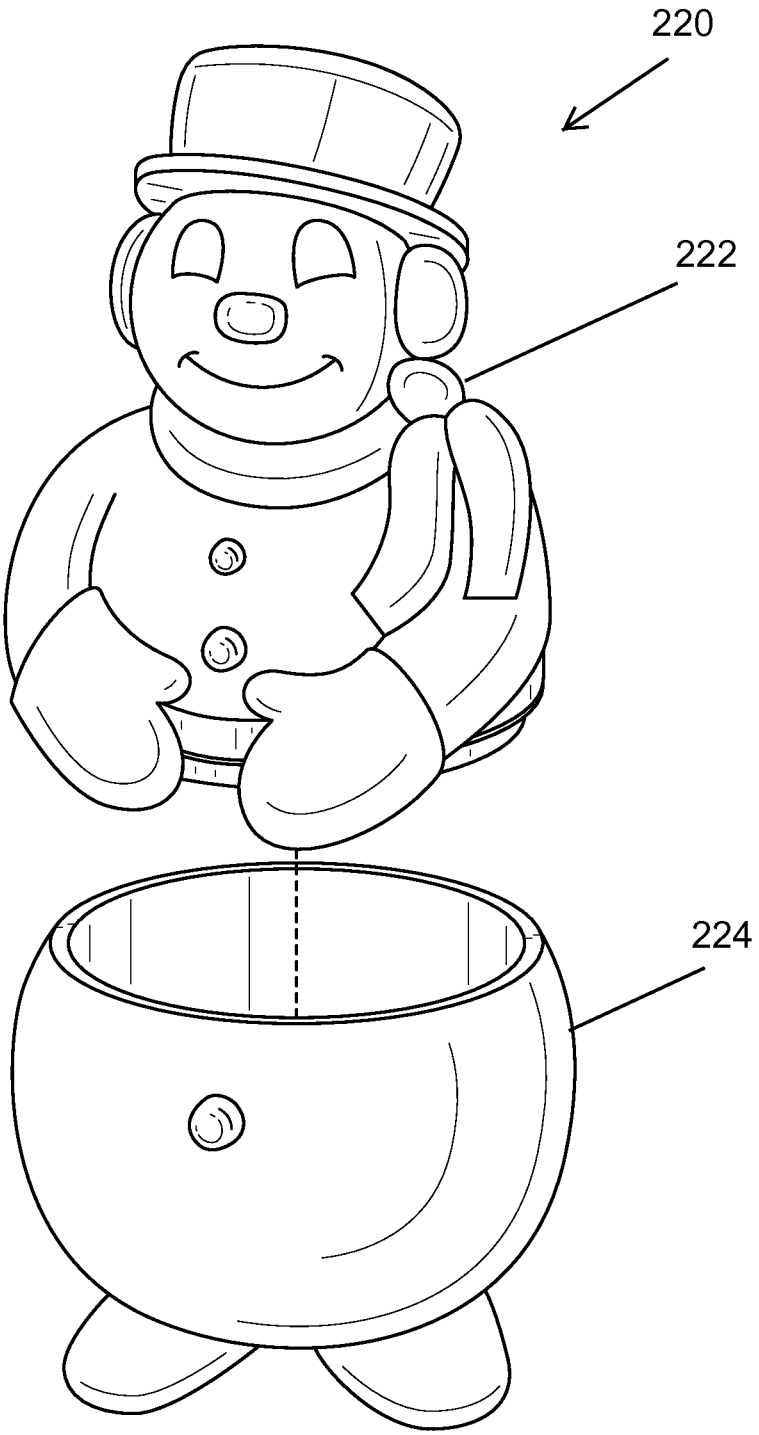
FIG. 8 is another front perspective view of the decorative container of FIG. 7, shown in an open condition with the container cover above the container base.

For example, and as shown in FIGS. 7 and 8, a decorative container 220 may be shaped like a snowman, with a container cover 222 and a hollow container base 224. The container base 224 comprises a hollow structure, which may be shaped or formed to represent a lower portion of snowman, such as a lower or bottom ball of the snowman. The container cover 222 may comprise a hollow or solid structure, and is shaped or formed to represent an upper portion of the snowman, such as an upper or top ball or balls of the snowman. The hollow container base 224 is configured to hold ice melting or traction-enhancing material, such as salt pellets or salt tablets or briquettes or sand or the like. The container cover 222 is detachably or removably attachable at the container base 224 to conceal and encase and substantially seal the ice melting or traction-enhancing material in the decorative container 220 when the cover is attached at the base and to allow for a user to remove and use some of the ice melting or other traction-enhancing material when the container cover 222 is removed from the container base 224, such as in a similar manner as discussed above. In the illustrated embodiment of FIGS. 7 and 8, the lower container base 224 is in the shape of the designed snowman, but the lower container base may otherwise be a generally cylindrical shape of the like, such as the shape of a standard bucket or the like, in which the ice melting materials are originally packaged and sold, such as in a similar manner as discussed above with respect to container 120.

Figure 9:
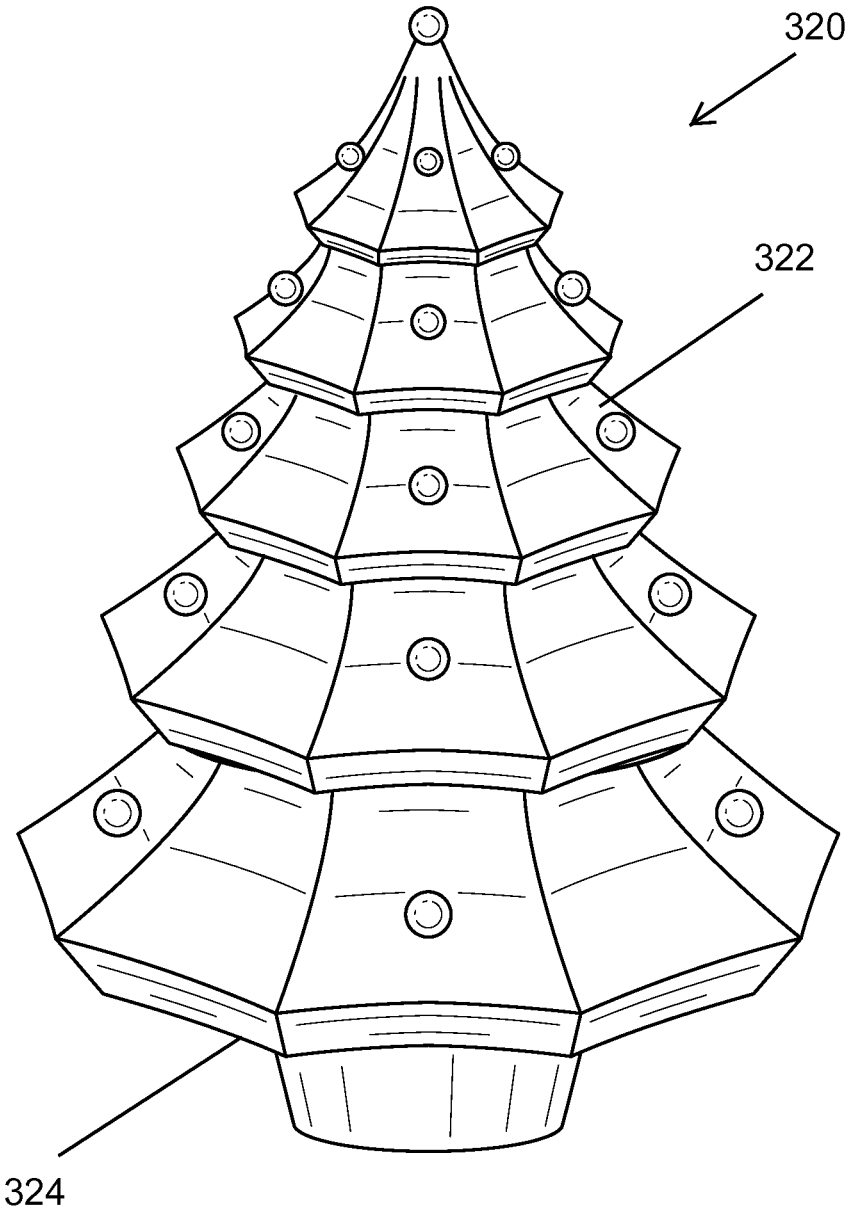
FIG. 9 is a front perspective view of another decorative container for ice melting materials in accordance with the present invention, shown in a closed condition with the container cover removably attached to the container base.
Figure 10:
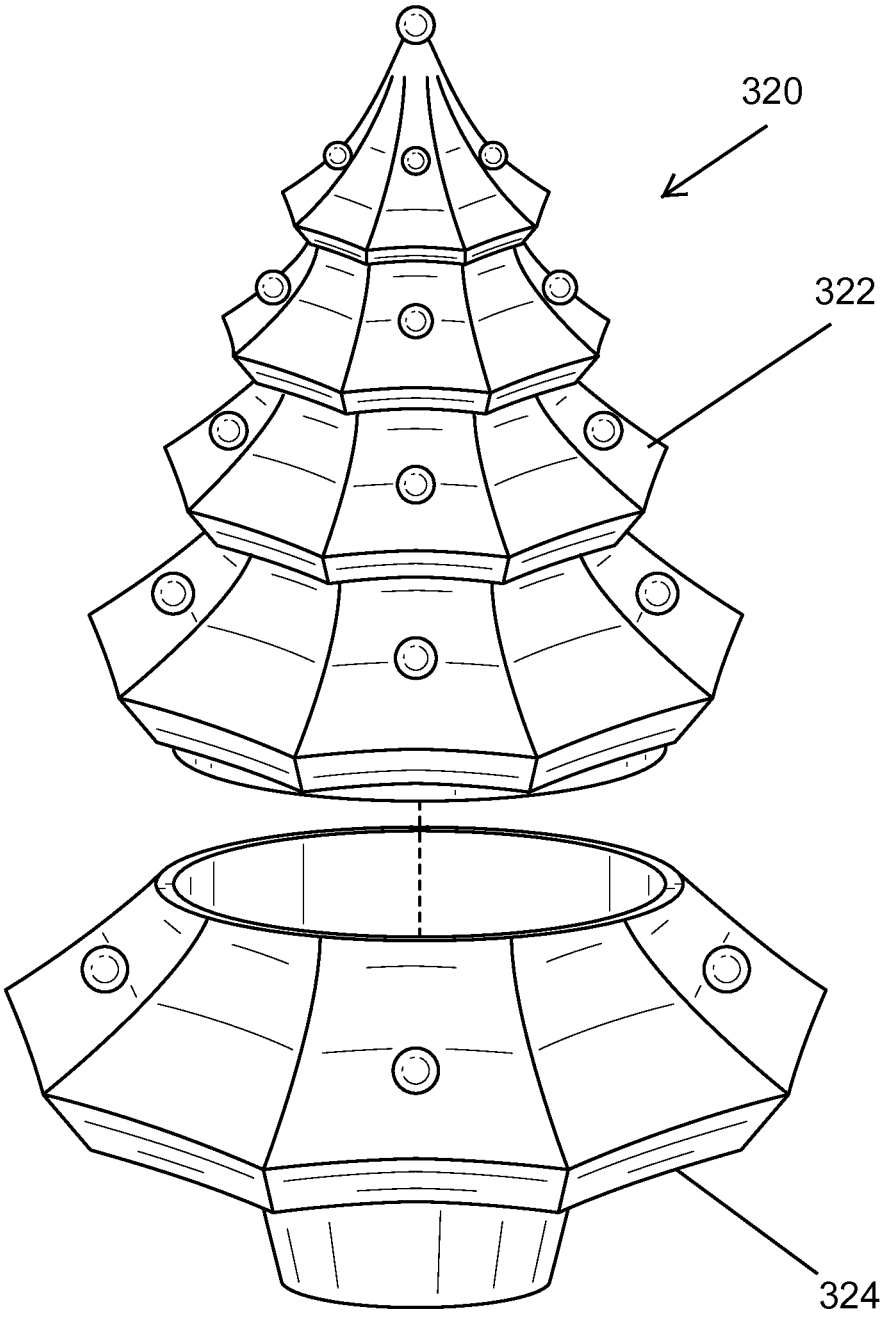
FIG. 10 is another front perspective view of the decorative container of FIG. 9, shown in an open condition with the container cover above the container base.

Optionally, and as shown in FIGS. 9 and 10, a decorative container 320 may be shaped like a Christmas tree, with a container cover 322 and a hollow container base 324. The container base 324 comprises a hollow structure, which may be shaped or formed to represent a lower portion of Christmas tree, such as the trunk of the tree or the trunk and lower branches of the tree. The container cover 322 may comprise a hollow or solid structure, and is shaped or formed to represent an upper portion of the tree, such as an upper or top branches of the tree. The hollow container base 324 is configured to hold ice melting material or traction-enhancing material, such as salt pellets or salt tablets or briquettes or sand or the like. The container cover 322 is detachably or removably attachable at the container base 324 to conceal and encase and substantially seal the ice melting or traction-enhancing material in the decorative container 320 when the cover is attached at the base, and to allow for a user to remove and use some of the ice melting or other traction-enhancing material when the container cover 322 is removed from the container base 324, such as in a similar manner as discussed above. In the illustrated embodiment of FIGS. 9 and 10, the lower container base 324 is in the shape of the designed Christmas tree, but the lower container base may otherwise be a generally cylindrical shape of the like, such as the shape of a standard bucket or the like, in which the ice melting materials are originally packaged and sold, such as in a similar manner as discussed above with respect to container 120.

Figure 11:
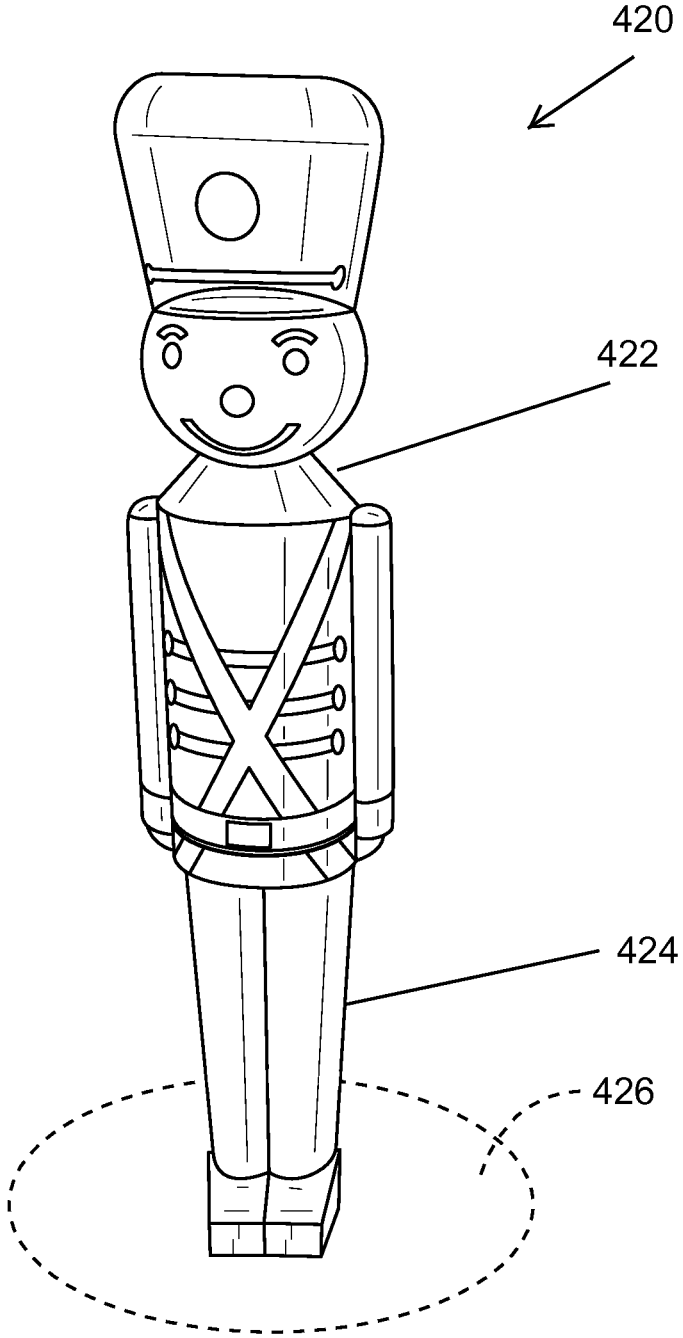
FIG. 11 is a front perspective view of another decorative container for ice melting materials in accordance with the present invention, shown in a closed condition with the container cover removably attached to the container base.
Figure 12:
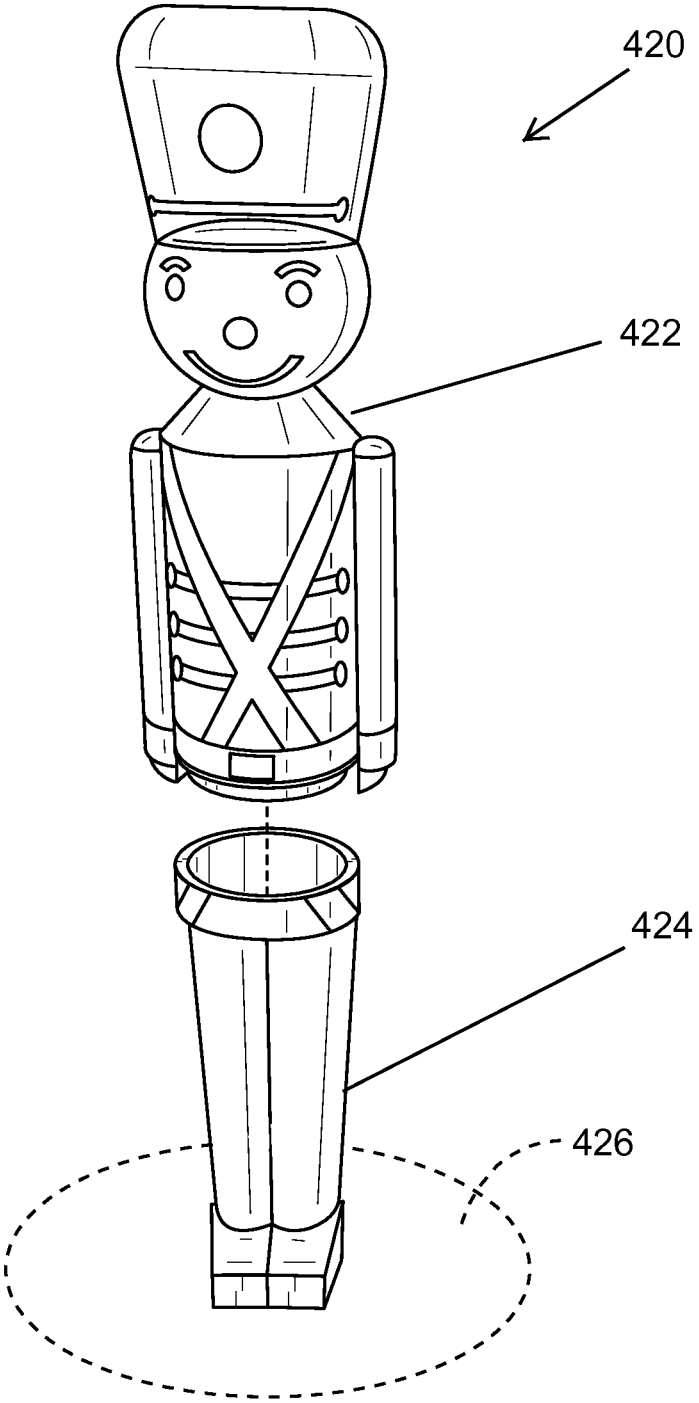
FIG. 12 is another front perspective view of the decorative container of FIG. 11, shown in an open condition with the container cover above the container base.

Optionally, and as shown in FIGS. 11 and 12, a decorative container 420 may be shaped like a toy soldier, with a container cover 422 and a hollow container base 424. The container base 424 comprises a hollow structure, which may be shaped or formed to represent a lower portion of toy soldier, such as the legs and part of the torso of the toy soldier. The container cover 422 may comprise a hollow or solid structure, and is shaped or formed to represent an upper portion of the soldier, such as the head and upper torso of the toy soldier. The hollow container base 424 is configured to hold ice melting or other traction-enhancing material, such as salt pellets or salt tablets or briquettes or sand or the like. The container cover 422 is detachably or removably attachable at the container base 424 to conceal and encase and substantially seal the ice melting or traction-enhancing material in the decorative container 420 when the cover is attached at the base and to allow for a user to remove and use some of the ice melting or traction-enhancing material when the container cover 422 is removed from the container base 424, such as in a similar manner as discussed above. In the illustrated embodiment of FIGS. 11 and 12, the lower container base 424 is in the shape of the designed toy soldier, but the lower container base may otherwise be a generally cylindrical shape of the like, such as the shape of a standard bucket or the like, in which the ice melting materials are originally packaged and sold, such as in a similar manner as discussed above with respect to container 120. Optionally, for stability, a base plate or stand 426 may be established or attached at the feet of the toy soldier form (or to the base or bottom of any other design or form of the containers of the present invention) to reduce tipping of the container.

Therefore, the present invention provides a decorative container and method for storing ice melting materials that overcomes the drawbacks of the prior art. Embodiments of the present invention not only provide a storage container for ice melting and/or traction-enhancing materials that is suitable for display near the entrance to a home or business, but also a container that can be incorporated as part of a homeowner's or facility's outdoor seasonal decorations.

Optionally, the container cover may be designed to fit onto a correspondingly decorative or formed base, or may fit directly onto the ice melting material's original packaging container. The decorative container cover may thus transform the original packaging into an aesthetically pleasing storage unit while avoiding the need to transfer the ice melting or traction-enhancing material to a separate container.

Changes and modifications to the specifically described embodiments may be carried out without departing from the principles of the present invention, which is intended to be limited only by the scope of the appended claims as interpreted according to the principles of patent law including the doctrine of equivalents.

The embodiments of the invention in which an exclusive property is claimed are defined as follows:

1. A decorative container assembly for traction-enhancing materials, said decorative container assembly comprising:

a container base having an outer surface, an inner storage cavity with a depth extending substantially toward a lower end portion of the container base for holding the traction-enhancing materials, and a lower mating element at an opening of the inner storage cavity;

a container cover having an outer surface and an upper mating element, wherein said outer surface of said container cover comprises continuous external side and top surfaces that are shaped together to form a winter theme character or structure;

a traction-enhancing material disposed in the inner storage cavity, said traction-enhancing material comprising at least one of salt, sand, and gravel;

wherein said traction-enhancing material is removable through the opening when the container cover is removed from the container base;

wherein said upper mating element of said container cover is configured to removably attach to said lower mating element of said container base to thereby attach said container cover at said container base and to substantially seal said inner storage cavity; and wherein said container base comprises a bucket-shaped portion of a packaging container for said traction-enhancing material.

2. The decorative container assembly of claim 1, wherein said bucket-shaped portion includes a handle.

3. The decorative container assembly of claim 2, wherein said outer surface of said container cover is decoratively colored in two or more different colors.

4. The decorative container assembly of claim 1, wherein said lower mating element of said container base comprises a peripheral rim circumscribing the opening of the inner storage cavity of said packaging container for said traction-enhancing materials.

5. The decorative container assembly of claim 1, further comprising a first retaining element at said upper mating element and a second retaining element at said lower mating element, wherein said first and second retaining elements are configured to detachably engage one another to releasably attach said lower mating element to said upper mating element.

6. The decorative container assembly of claim 5, wherein said first retaining element comprises a protrusion and said second retaining element comprises a recess.

7. The decorative container assembly of claim 1, wherein said traction-enhancing material comprises at least one of sand and gravel and at least one of salt pellets, salt tablets, and salt briquettes.

8. The decorative container assembly of claim 1, wherein said outer surface of said container cover is shaped in a decorative manner to have the form of at least an upper portion of a winter theme character or structure.

9. The decorative container assembly of claim 8, wherein said outer surface of said container base is shaped in a decorative manner to have the form of a lower portion of the winter theme character or structure.

10. The decorative container assembly of claim 9, wherein said container base comprises a hardened resinous plastic configured to be resistant to corrosion in the presence of salt, moisture, and cold temperatures, and wherein said outer surfaces of said container base and said container cover coalesce upon attaching the upper mating element to the lower mating element for forming the winter theme character or structure.

11. The decorative container assembly of claim 1, wherein said container cover includes a hollow interior cavity for receiving a portion of said traction-enhancing material stored in said container base.

12. The decorative container assembly of claim 1, further comprising a base plate coupled to a lower end portion of said container base, wherein said base plate is configured to stabilize said container.

13. A decorative container assembly for storing traction-enhancing materials outdoors, said decorative container assembly comprising:

a container base comprising a bucket-shaped portion of a packaging container for holding a traction-enhancing material, said container base having an inner storage cavity for holding said traction-enhancing material and a lower mating element at an upper opening of the inner storage cavity;

a container cover having a decorative outer surface and an upper mating element, wherein said decorative outer surface comprises continuous external side and top surfaces that are shaped together to form a winter theme character or structure, and wherein said container cover defining a hollow cavity for receiving a portion of said traction-enhancing material when protruding out of the upper opening of the inner storage cavity of the container base;

wherein said traction-enhancing material comprises at least one of sand, gravel, salt tablets, salt pellets, and salt briquettes disposed in the inner storage cavity and removable through the upper opening when said container cover is removed therefrom;

wherein said container base comprises a hardened resinous plastic configured to be resistant to corrosion in the presence of salt, moisture, and cold temperatures;

wherein said bucket-shaped portion of said packaging container for said traction-enhancing material comprises a carry handle;

wherein said outer surface of the container cover is shaped in a decorative manner to have the form of at least an upper portion of a winter theme character or structure; and wherein said upper mating element of said container cover is configured to removably attach to said lower mating element of said container base to thereby attach said container cover at said container base and to substantially seal said inner storage cavity.

* * * * *